US010618110B2

(12) United States Patent
L'Esperance et al.

(10) Patent No.: US 10,618,110 B2
(45) Date of Patent: Apr. 14, 2020

(54) MASTER ALLOY FOR PRODUCING SINTER HARDENED STEEL PARTS AND PROCESS FOR THE PRODUCTION OF SINTER HARDENED PARTS

(75) Inventors: Gilles L'Esperance, Candiac (CA); Ian Bailon-Poujol, Boucherville (CA); Denis Christopherson, Jr., Waupun, WI (US)

(73) Assignee: Tenneco Inc., Lake Forest, IL (US)

( * ) Notice: Subject to any disclaimer, the term of this patent is extended or adjusted under 35 U.S.C. 154(b) by 1075 days.

(21) Appl. No.: 13/579,083

(22) PCT Filed: Feb. 15, 2011

(86) PCT No.: PCT/CA2011/050088

§ 371 (c)(1),
(2), (4) Date: Aug. 15, 2012

(87) PCT Pub. No.: WO2011/097736

PCT Pub. Date: Aug. 18, 2011

(65) Prior Publication Data

US 2013/0039796 A1 Feb. 14, 2013

Related U.S. Application Data

(60) Provisional application No. 61/304,600, filed on Feb. 15, 2010.

(51) Int. Cl.
*C22C 35/00* (2006.01)
*B22F 1/00* (2006.01)
(Continued)

(52) U.S. Cl.
CPC ..... *B22F 3/1028* (2013.01); *C22C 33/02* (2013.01); *C22C 35/005* (2013.01); *B22F 1/0014* (2013.01); *C22C 1/03* (2013.01); *C22C 33/06* (2013.01)

(58) Field of Classification Search
CPC ..... C22C 1/03; C22C 1/042; C22C 33/006; C22C 33/0207; C22C 33/0257;
(Continued)

(56) References Cited

U.S. PATENT DOCUMENTS 2,129,346 A * 9/1938 De Golyer ..... C22C 38/04 420/120
3,165,400 A * 1/1965 Amedee ..... C22C 38/001 420/12
(Continued)

FOREIGN PATENT DOCUMENTS

CA 2721348 10/2009
DE 1011909 B 7/1957
(Continued)

OTHER PUBLICATIONS

Hardness Conversions for Steels, vol. 8, Mechanical Testing and Evaluation, ASM Handbook, ASM International, 2003, 12 pages total (online version).*
(Continued)

*Primary Examiner* — Vanessa T. Luk
(74) *Attorney, Agent, or Firm* — Robert L. Stearns; Dickinson Wright PLLC

(57) ABSTRACT

A master alloy used to produce the steel part and a process for producing a sinter hardened steel part from the master alloy are described. The powdered master alloy having a composition of iron, about 1 to less than 5 weight % C, about 3 to less than 15 weight % Mn, and about 3 to less than 15 weight % Cr, wherein the master alloy comprises a microstructure composed of a solid solution of the alloying elements and carbon, the microstructure comprising at least 10 volume % austenite and the remainder as iron compounds. The process comprises: preparing the master alloy, mixing the master alloy with a steel powder to produce a mixture wherein the weight % of the master alloy is from 5
(Continued)

to 35 weight % of the mixture, compacting the mixture into a shape of a part and sintering the mixture to produce the steel part, and controlling the cooling rate after sintering to produce sinter hardening. The master alloy powder can also be used as a sinter hardening enhancer when mixed with low-alloy steel powders.

7 Claims, 4 Drawing Sheets

(51) Int. Cl.

| | |
|---|---|
| ***C22C 33/02*** | (2006.01) |
| ***B22F 3/10*** | (2006.01) |
| *C22C 33/06* | (2006.01) |
| *C22C 1/03* | (2006.01) |

(58) Field of Classification Search
CPC . C22C 33/0278; C22C 33/0285; C22C 33/06; C22C 35/00; C22C 35/005; C22C 37/06; C22C 37/08; C22C 38/36; C22C 38/38; C22C 38/56; C22C 38/58; C22C 33/0214; C22C 33/0221; C22C 33/0228; C22C 33/0292; C22C 33/08; C22C 33/10; C22C 33/12; B22F 1/0014; C21D 2211/001
See application file for complete search history.

(56) References Cited

U.S. PATENT DOCUMENTS

| | | | | | |
|---|---|---|---|---|---|
| 3,663,214 | A * | 5/1972 | Moore | C22C 38/38 | 420/15 |
| 3,704,115 | A | 11/1972 | Wastenson et al. | | |
| 3,899,319 | A | 8/1975 | Lindskog et al. | | |
| 4,340,432 | A | 7/1982 | Hede | | |
| 4,494,988 | A | 1/1985 | Schumacher et al. | | |
| 4,552,719 | A * | 11/1985 | Morimoto | C22C 33/0207 | 419/2 |
| 4,724,000 | A * | 2/1988 | Larson | C22C 33/0207 | 419/11 |
| 5,188,659 | A | 2/1993 | Purnell | | |
| 5,756,909 | A * | 5/1998 | Liimatainen et al. | 75/238 | |
| 6,783,568 | B1 | 8/2004 | Bowskill et al. | | |
| 6,866,816 | B2 * | 3/2005 | Liang | C22C 33/0285 | 148/324 |
| 7,153,339 | B2 * | 12/2006 | Lindsley | C22C 33/0207 | 419/39 |
| 2005/0220657 | A1 | 6/2005 | Lindsley et al. | | |
| 2005/0163645 | A1 | 7/2005 | Xu et al. | | |
| 2006/0193742 | A1 * | 8/2006 | Miura | B22F 1/0044 | 419/52 |
| 2010/0035775 | A1 * | 2/2010 | Viswanathan | C22C 32/0084 | 508/123 |
| 2011/0253264 | A1 * | 10/2011 | Gierl | C22C 33/0257 | 148/513 |

FOREIGN PATENT DOCUMENTS

| | | | | |
|---|---|---|---|---|
| EP | 1198601 | A1 | 4/2002 | |
| GB | 1449809 | | 9/1976 | |
| GB | 1504547 | | 3/1978 | |
| GB | 1504577 | | 3/1978 | |
| JP | S6436746 | A | 2/1989 | |
| JP | 03219050 | A * | 9/1991 | |
| WO | WO 0007759 | A1 * | 2/2000 | B22F 9/082 |
| WO | 2010070065 | A1 | 6/2010 | |

OTHER PUBLICATIONS

"Glossary of Metallurgical and Metalworking Terms," Metals Handbook, ASM International, 2002, pp. 1, 13, 14, 150, 257.*
"Glossary of Metallurgical and Metalworking Terms," Metals Handbook, ASM Handbooks Online, ASM International, 2002, p. 37.*
"Glossary of Metallurgical and Metalworking Terms," Metals Handbook, ASM Handbooks Online, ASM International, 2002, pp. 1, 13 , 14, 37, 116, 150, 214, 257. (Year: 2002).*
Standard U.S. Sieve Series, Table 1, Sieve and Fisher Subsieve Analysis of Metal Powders, ASM International, document accessed Sep. 19, 2008. (Year: 2008).*
International Search Report dated May 19, 2011 (PCT/CA2011/050088).
Supplementary European Search Report, dated Jun. 14, 2016 (Ep 11 74 1804).
Spiekermann P, "Legierungen—Ein Besonderes Patentrechtliches Problem?—Legierungspruefung Im Europaeischen Patentamt,", Mitteilungen Der Deutschen Patentanwaelte, Jan. 1, 1993(Jan. 1, 1993), pp. 178-190, XP000961882.

* cited by examiner

MASTER ALLOY FOR PRODUCING SINTER HARDENED STEEL PARTS AND PROCESS FOR THE PRODUCTION OF SINTER HARDENED PARTS

CROSS-REFERENCE TO RELATED APPLICATIONS

This application claims priority under 35 USC § 119(e) of U.S. provisional patent application 61/304,600 filed on Feb. 15, 2010, the specification of which is hereby incorporated by reference.

FIELD OF INVENTION

The invention relates to a master alloy used for producing hardened steel part via sinter hardening and to a process for producing a sinter hardened steel part including the master alloy.

BACKGROUND OF THE INVENTION

Hardening alloying elements are widely used in powder metallurgy to produce high performance steel parts. These hardening alloying elements include: nickel, molybdenum and copper. One of the disadvantages of these alloying elements is their high and often fluctuating costs.

In traditional wrought steel metallurgy, additional hardening alloying elements comprise manganese, chromium and silicon. Manganese is a particularly effective hardening alloy. These additional alloying elements are less expensive and their costs tend to be more stable. The main disadvantage of these less expensive elements is that they are prone to oxidation which has, until now, limited their use in powder metallurgy.

There are a number of ways to introduce alloying elements in a powder metallurgy component. One of the ways involves adding alloying elements in the liquid steel before atomization (pre-alloying). Another way is to add the alloying elements to the powder mix as an additive (admixed). Pre-alloyed powders exhibit a relatively lower compressibility but produce more homogenous microstructures/properties. On the other hand, admixed alloying elements hinder the compressibility less but require higher sintering temperatures to ensure atomic diffusion, thus homogenous microstructures/properties.

GB 1,504,547 by Zaft et al, assigned to the company Sintermetallwerk Krebsöge GmbH, teaches a sintered alloy steel made by pressing and sintering a powder mixture with steel powder and a complex carbide hardening ferro-alloy containing the following elements: Cr up to 25%, Mo up to 25%, Mn up to 25%, C up to 10% as complex carbides and balance Fe. This exclusively containing carbide hardening ferro-alloy of Zaft et al., is very hard and can cause wear in the equipment and tools used in the production of steel parts ("Process for making alloyed steel sintered parts and sinter powder for use in the process" by G. Zapf et al., Patent GB 1,504,547, 1974). The conclusion that the master alloy of Zaft et al, causes excessive tool wear in processing equipment is explained in "New Cr—Mn-alloyed sintered steel for high-performance applications" by Paul Beiss, Advances in Powder Metallurgy & Particulate Materials, Part 7, Page 24, 2005.

Therefore, there is a need for a softer or less-hard master alloy for the production of hardened alloy steel parts, that reduces the use of costly hardening alloying elements and minimizes tool wear during production of these parts with a resulting saving in material as well as in production costs. It therefore makes the process viable. This master alloy should also protect from oxidation the oxygen-affinitive elements such as manganese and chromium during processing.

SUMMARY

The master alloy and process presented herein allows for the use of less costly hardening alloying elements that have higher affinity for oxygen. Particularly, manganese and chromium are protected against oxidation when in solid solution in carbon containing phases, such as austenite and other compounds containing carbon. The presence of carbon in solid solution protects these alloying elements from oxidation during master alloy production and subsequent processing steps including sinter hardening.

In one aspect of the invention, there is provided a master alloy comprising a composition of about 1 to less than 5 weight % C in the master alloy, about 3 to less than 15 weight % Mn in the master alloy, about 3 to less than 15 weight % Cr in the master alloy, and a remainder Fe and unavoidable impurities; wherein the master alloy comprises a microstructure composed of a solid solution of the alloying elements and carbon, the microstructure comprising at least 10 volume % austenite and the remainder as iron compounds.

In another aspect of the invention, there is provided a process for producing a sinter hardened steel part comprising: preparing a powder of a master alloy comprising a composition of about 1 to less than 7 weight % C in the master alloy, about 3 to less than 20 weight % Mn in the master alloy, about 3 to less than 20 weight % Cr in the master alloy, and a remainder Fe and unavoidable impurities: wherein the master alloy comprises a microstructure composed of a solid solution of the alloying elements and carbon, the microstructure comprising at least 10 volume % austenite and the remainder as iron compounds, mixing the master alloy powder with a steel powder to produce a mixture wherein the weight % of the master alloy is from 5 to 35 weight % of the mixture: compacting the mixture to shape the part: sintering the mixture to produce the steel part: and controlling the cooling following sintering in order to generate sinter hardening.

According to a general aspect, there is provided a master alloy for sinter hardened steel parts, the master alloy comprising a composition of iron: about 1 to less than about 5 weight % C in the master alloy, about 3 to less than about 15 weight % Mn in the master alloy, about 3 to less than about 15 weight % Cr in the master alloy, and wherein the master alloy comprises a microstructure composed of a solid solution of the alloying elements and carbon, the microstructure comprising at least 10 volume % austenite.

According to another general aspect, there is provided a process for producing a sinter hardened steel part comprising: preparing a powder of a master alloy comprising a composition of iron: about 1 to less than 7 weight % C in the master alloy, about 3 to less than 20 weight % Mn in the master alloy, about 3 to less than 20 weight % Cr in the master alloy, and wherein the master alloy comprises a microstructure composed of a solid solution of the alloying elements and carbon, the microstructure comprising at least 10 volume % austenite, mixing the master alloy powder with a steel powder to produce a mixture wherein the weight % of the master alloy is from 5 to 35 weight % of the mixture: compacting the mixture to shape the part: sintering the mixture to produce the steel part: and controlling the cooling following sintering in order to generate sinter hardening.

According to a further general aspect, there is provided a sinter hardened steel part obtained by the process described above.

According to still another general aspect, there is provided a powder mixture for producing a steel part, comprising: a steel powder: and a master alloy powder in a concentration ranging between about 5 and about 35 weight % of the powder mixture, the master alloy powder comprising: iron: about 1 to less than 7 weight % C in the master alloy powder, about 3 to less than 20 weight % Mn in the master alloy powder, about 3 to less than 20 weight % Cr in the master alloy powder, and wherein the master alloy comprises a microstructure composed of a solid solution of the alloying elements and carbon, the microstructure comprising at least 10 volume % austenite.

In this specification, the term "master alloy" is intended to mean a base metal such as iron pre-alloyed with one or more additional elements, for instance, carbon (C), manganese (Mn) and chromium (Cr), that is added to the base metal melt. Master alloys are obtained by atomization of a molten bath of the master alloy prepared, with a suitable high-pressure medium, such as a liquid or a gas. The master alloy particles are of micrometer order size.

In this specification, the term ferroalloy is intended to mean various alloys of iron with a high proportion of one or more element(s). Ferroalloys are obtained by casting, moulding, and crushing. The ferroalloy particles are of millimeter order size, i.e. about 1000 times larger than the master alloy particles.

BRIEF DESCRIPTION OF DRAWINGS

Reference will now be made to the accompanying drawings, showing by way of illustration a particular embodiment of the present invention and in which.

DETAILED DESCRIPTION

The present invention describes sinter hardening that consists of controlling the cooling rate of the sintering cycle to generate relatively hard microstructures containing a mixture of martensite, bainite and perlite phases without the use of a separate heat treatment particularly consisting of austenitization and quenching in oil or water. The less expensive alloying elements of interest here (manganese and chromium) allow sinter hardening via the process of the present invention. The absence of a separate heat treatment reduces the overall operating costs of the process and reduces the distortion of a part which is often induced by quenching the part in oil or water. Finally, sinter hardening is less expensive and more environmentally friendly than oil quench heat treatments. Sinter hardening eliminates oil emissions in the atmosphere and the need for cleaning the quenched parts and reduces health and safety hazards associated with high temperature oil baths. The present invention successfully achieves the production of hardened steel parts using less costly alloying elements. Alloying elements are protected from oxidation by the presence of a high carbon content in the liquid metal prior to atomization.

Figure 1:
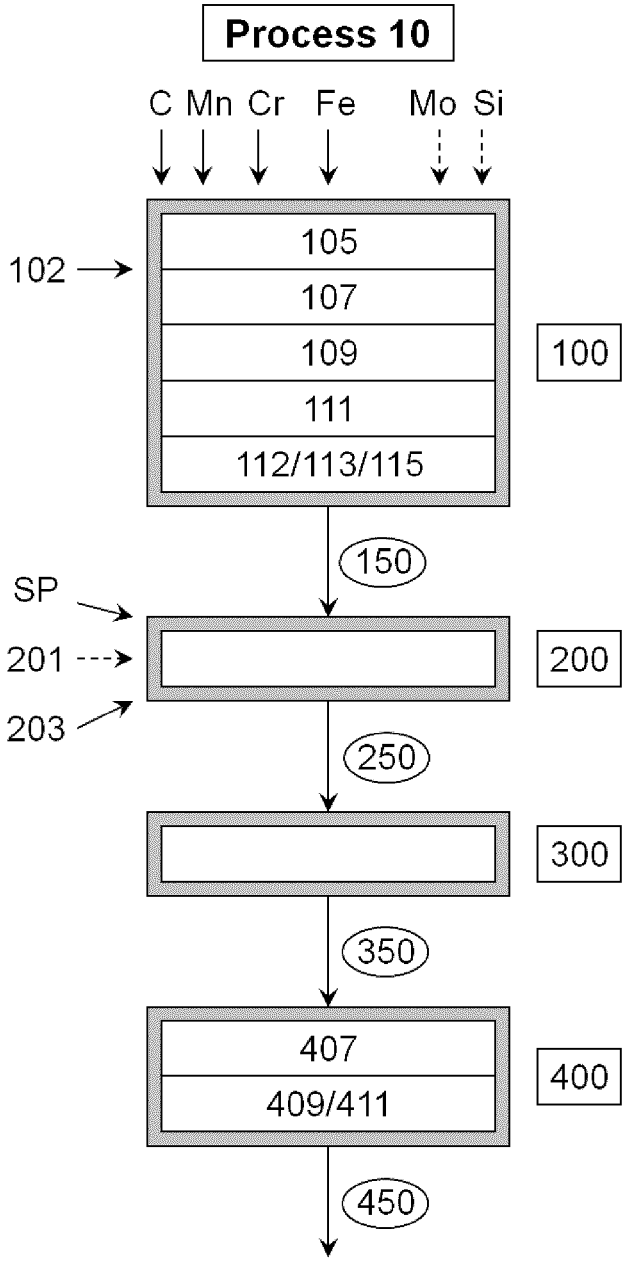
FIG. 1 is a block diagram of a process for producing a master alloy powder and a sinter hardened steel part according to an embodiment.

Referring now to the drawings, FIG. 1 is a block diagram of a process 10 for the production of a sinter hardened steel part 450 according to the present invention, through the production of a powdered master alloy 150.

The process 10 for producing a sinter hardened steel part includes four main steps. The first step 100 is the preparation of a master alloy in a powder form, including atomization and grinding. The second step 200 is the mixing of the powdered master alloy 150 with a base steel metal powder, SP, where SP stands for "steel powder". The third step 300 is a pressing or compaction of the powder master alloy 150 and the base steel powder SP. The process is completed with a sintering step 400 having controlled cooling to produce the desired microstructures and properties.

Step 100 of preparing the master alloy powder 150 begins with the melting 105 of various elements to produce a molten bath of master alloy. The master alloy has a composition comprising the following elements: carbon (C), manganese (Mn), chromium (Cr), and optionally molybdenum (Mo), silicon (Si) or copper (Cu). Other alloying elements can also be used including but not limited to: V, W, Nb, Ni, P and B. The choice of additional alloying elements is usually based on market conditions in order to achieve a relatively low cost master alloy an the required hardening. The typical molten bath temperature in the melting process 105 will be in the order of 1400-1700° C. although there will be some variation that depends on the chemistry of the melt. The remainder of the alloy is completed with iron and unavoidable impurities.

The typical concentrations of the elements in the molten bath are: about 1 to less than 7 weight % C, about 3 to less than 20 weight % Mn, and about 3 to less than 20 weight % Cr, the balance being the master alloy and any unavoidable impurities. The composition of the master alloy may optionally include 0-10 weight % Mo; optionally 0-10 weight % Si, and optionally 0-10 weight % Cu. The composition of the master alloy may optionally also include 0-5 weight % V, 0-5 weight % W, 0-5 weight % Nb, 0-5 weight % Ni, 0-1 weight % P and 0-0.1 weight % B. Cross hashed lines in FIG. 1 represent the optional addition of Mo, Si and other alloying elements in step 100.

In an alternative embodiment, the master alloy includes between about 1 to less than 5 weight % C, about 3 to less than 15 weight % Mn, and about 3 to less than 15 weight % Cr. In still another embodiment, the master alloy includes between about 2 to less than 5 weight % C, about 5 to less than 15 weight % Mn, and about 5 to less than 15 weight % Cr.

In an embodiment, the composition of the master alloy includes at least 60 weight % of iron.

The term "weight %" is defined as the weight of the element over the total weight of a mixture as a whole multiplied by 100.

With the molten bath of the master alloy prepared, the bath is atomized 107 (or pulverized), with a suitable high-pressure medium, such as a liquid or a gas, which produces an atomized powder. In an embodiment, a water atomization process is used and the protective atmosphere 102 during the atomizing step 107 is argon.

The atomized powder is dried in a drying unit operation 109 well known to the person skilled in the art.

An optional reduction heat treatment can be applied to the atomized/dried master allow powder in order to reduce and remove any oxides that may have been formed during water atomisation. Furthermore, the heat treatment has the potential to improve the compressibility of the master alloy powder. In an embodiment, the reduction heat treatment can be carried out at a temperature ranging between 800° C. and 1100° C. during about 0.5 to 10 hours.

The atomized master alloy powder produced can undergo a milling step 111. The milling step 111 of the atomized powder can be achieved in any one of the following equipment: ball mill, planetary mill, impact mill or any other suitable grinding apparatus. After milling, a ground master alloy powder is obtained with a $d_{50}$ between 5-30 μm, and in an embodiment the $d_{50}$ is between 5-15 μm.

$d_{50}$ is the median of the particle size distribution. Thus, in volume, 50% of the particles have a larger size than $d_{50}$ and the remaining 50% are smaller than $d_{50}$. $d_{10}$ and $d_{90}$ represent the particle sizes where 10% and 90% of the particles are smaller than $d_{10}$ and $d_{90}$, respectively.

The usage of a process control agent as an additive during milling can enhance the fineness of the ground powder. In an embodiment, the process control agent used is stearic acid and is mixed with atomized master alloy powder in a proportion of about 0 weight % to about 2 weight % before milling. The stearic acid molecules adhere to the fresh metal surfaces created during grinding (fractured particles) and impede the aggregation phenomenon, thus allowing the production of a finer master alloy powder. By using a process control agent, it has been possible to produce a ground master alloy powder with a $d_{50}$ as low as about 6 nm.

Process control agents are added to the powder mixture during milling to reduce the effect of cold welding. The PCAs can be solids, liquids, or gases. They are mostly, but not necessarily, organic compounds, which act as surface-active agents. The PCA adsorbs on the surface of the powder particles and minimizes cold welding between powder particles and thereby inhibits agglomeration. One skilled in the art will appreciate that other process control agents can be used such as and without being limitative methanol, ethanol, hexane, and the one cited in Suryanarayana, Mechanical alloying and milling, Progress in Materials Science 46 (2001), pp. 1-184, which is hereby incorporated by reference.

An optional annealing heat treatment 112 may be applied to the master alloy powder in order to reduce its hardness and improve the compressibility of the powder.

The ground and optionally annealed master alloy powder can be classified 113, using any one of a variety of known methods such as screening, or air classification. The classifying step 113 typically removes particles larger than 45 nm. The $d_{50}$ remains in the range of 5 nm and 30 nm, and, in a narrower embodiment, 5 nm to 15 nm while the $d_{90}$ is in a range of 20 nm to 45 nm and, in a narrower embodiment, $d_{90}$ is less than 30 nm.

The classified or screened particles may optionally be magnetically separated 115 to remove any oxide residues that may have been formed during any one of the preceding process steps of preparing the master alloy 100. Thus, after the classification/magnetic separation step or steps, the powdered master alloy 150 is ready for further processing towards the production of the sinter hardened steel part 450.

An important aspect of the present invention is the form of the carbon within the master alloy. Indeed, carbon contained in the master alloy particles is present in solid solution in austenite and in compounds and is redistributed during sintering. The presence of austenite containing carbon in solid solution allows for the reduction of the hardness of the master alloy 150 without compromising the protection of the elements with a high affinity for oxygen. In addition, the fact that carbon is pre-alloyed to the master alloy also helps to reduce or eliminate the addition of graphite in the mix. This however clearly depends on the final chemistry of the part required and the amount of master alloy 150 used. Reducing the amount of graphite in the mix is beneficial to reduce segregation and therefore to reduce the variation of properties in the final part. This also reduces graphite emissions in the air which is beneficial to health and environment. Finally, reducing the hardness of the master alloy reduces the wear on the compacting tools.

For instance and without being limitative, the composition of the steel powder mixture may include between about 0 and 0.4 weight % of graphite. This is lower than typical graphite additions used in ferrous powder metallurgy which are generally above 0.5 wt % for sinter hardening and other high strength applications.

Carbon and alloying elements are then redistributed during sintering by atomic diffusion. The fact that carbon is pre-alloyed to the master alloy powder also enhances the effectiveness of the atomic diffusion of the alloying elements in the steel particles, when compared to mixes containing carbon in the form of graphite powder or a mixture of ferro-alloys and graphite.

The amount of carbon in the master alloy is therefore determined by a number of factors including the hardness of the atomized master alloy, the protection against oxidation of the alloying elements, and the amount of graphite added to the mix.

"Austenite" is understood to be a solid solution of C in gamma-Fe, that is a non-magnetic allotrope of iron or a solid solution of iron with an alloying element.

Pure austenite may contain up to 2.1 weight % C in solid solution. When the austenite is saturated (i.e. C weight %>2.1%) another carbon rich phase is formed at equilibrium, particularly cementite (iron carbide) or graphite. To obtain graphite, the alloy must also contain graphitizing alloying elements such as Si, and the solidification/coating is conducted relatively slowly. This is not the case for the present invention. The relative proportions of the phases when the C weight % is >2.1% may be obtained by interpolation. Therefore:—an alloy containing 2.1% C contains 100% austenite saturated in C; an alloy containing 6.7% C contains 100% cementite ($Fe_3C$).

Thus, an alloy having a composition between 2.1% weight C and 6.7% weight C, has a mixture of the two phases of austenite and cementite. The lower the C % weight is, the larger is the volumetric fraction of austenite in the alloy microstructure.

Thus, the master alloy contains a number of iron phases, one of which is the relatively soft austenite phase, in comparison to iron carbide phases such as cementite. The ratio of austenite increases as the amount of carbon in the master alloy decreases. The presence of austenite in the master alloy lowers its hardness, hence reduces tool wear during compaction. A level of about 20 weight % of austenite is obtained with about 4.5 weight % C in the master alloy, resulting in a hardness of approximately 850 HV. The % volume of the microstructural constituents, which includes austenite and cementite phases and, possibly, one or more other phases, is generally obtained by careful microscopic observations.

Thus, the master alloy is produced by atomization and the desired particle size is obtained by a subsequent grinding step.

The second step 200 of the process 10 for producing a sinter hardened steel part 450 is a mixing step where the particulate master alloy 150 and a base steel powder SP are mixed. In an embodiment, a highly compressible steel powder is used as the base steel metal powder. For instance, the base steel powder SP may be a nearly pure steel powder or a low alloyed steel powder, which can either be pre-alloyed or diffusion bonded, which are commercially available and used in powder metallurgy. In an embodiment, the steel powder SP includes less than about 0.01 wt % of carbon. In an embodiment, the total content of the alloying elements of the low alloyed steel powder SP is lower than about 2 wt %.

A small amount of graphite powder 201 may optionally be added to the mix depending on the quantity of master alloy used, the chemistry of that master alloy, and the final carbon content required in the part. Lubrication techniques well known to those skilled in the art, such as admixed lubricant or die-wall lubrication 203, are used in order to obtain a more compressible mixture. Up to 1 weight % of the total steel powder mixture may be made up of a lubricant.

The new process is particularly effective when the master alloy 150 is used in higher weight percentages.

The master alloy 150 can also optionally be diffusion bonded to the base steel powder prior to mixing with the lubricant, graphite and other additives.

Other powdered additives such as copper and nickel powder can also be optionally admixed to the mixture in step 200. This practice is well known by those skilled in the art.

The present process uses a larger percentage of the powder of master alloy 150 to the base steel powder SP than previously known in the art. This leads to a more homogeneous spatial distribution of the alloying elements and therefore, of the microstructural constituents for a wide range of sintering temperatures. Moreover, the above-described master alloy is not as hard as previously developed hardening ferro-alloy having carbon exclusively in the form of carbides. The low hardness of the above-described master alloy reduces tool wear.

The percentage weight of master alloy in the particulate mixture 250 varies from 5 to 35 weight %, and in an embodiment from 5 to 20%.

For the particulate mixing step 200, the combination of higher weight % of master alloy to the base steel powder SP, the fine particle size distribution of the master alloy 150, as well as a good spatial distribution of the master alloy within the SP mix, are characteristics that are particularly well suited for robust sinter hardening. The aforementioned characteristics afford the produced steel product or part with a good level of microstructural homogeneity, while the carbon in solid solution within the master alloy protects the more readily oxidized elements such as Mn from oxidation during atomization and subsequent processing.

The third step 300 of the production process 10 shown in FIG. 1 is compaction or pressing of the mixture 250 described previously. The particulate mixture 250 is placed under shape retaining conditions, by any one of several compression methods, known to the person skilled in the art including but not limited to: room temperature compaction, warm compaction, forging and hot isostatic pressing (HIP), that produce a compressed part or compact 350.

The fourth step of the production process 10 is sintering 400. The compressed particulate or compact 350 undergoes a sintering 407 at a high temperature in a range including, but limited to, 1100° C. to 1300° C. in a furnace using a gas atmosphere such as, but not limited to, $H_2/N_2$ atmosphere. These commonly used gas atmospheres are known by those skilled in the art. The length of time for the sintering step 407 to produce a sintered part is typically between 15 and 60 minutes.

The final step of sintering 400 is sinter hardening which is produced by a controlled cooling 409 of the sintered part in a critical temperature range of normally between 550° C. and 350° C. at a cooling rate larger than of 0.5° C./second (30° C./minute) in order to generate a hardened steel component. In other words, when the temperature reaches about 550° C., the cooling rate is controlled until it reaches about 350° C. The control of the cooling rate allows generating an appropriate microstructure which can consist mainly of martensite at high cooling rates, bainite/perlite/ferrite at low cooling rates and a mix of martensite/bainite/perlite/ferrite at intermediate cooling rates. Each microstructure leads to different mechanical properties. Combined with the appropriate choice of alloying elements, this controlled cooling step imparts the hardening characteristics to the steel part 450. A final cooling step 411 is required to attain room temperature.

A tempering heat treatment (not shown in FIG. 1) may be applied to the as-sintered part in order to enhance ductility and toughness of the part. At a microscopic scale, martensite, the hard phase generated during sinter hardening, is tempered. Toughness is imparted by tempered martensite which is less brittle than the as-sintered martensitic phase. In an embodiment, tempering is carried out at 150-250° C. for up to 60 minutes.

Optional secondary operations such as machining, impregnation, infiltration, or coating can be performed on the sintered steel part, prior to or after the tempering heat treatment.

EXAMPLES

The process of the present invention is further described by way of the following examples. Table 1 outlines the elemental composition of the different base steel powders and master alloys used in the following examples. Powder A is essentially an unalloyed and highly compressible steel powder while powder B is a low pre-alloyed steel powder.

TABLE 1

Powders used in Examples 1, 2, 3, and 4.

| Powder | wt % C | wt % O | wt % Mn | wt % Cr | wt % Mo | wt % Si |
|---|---|---|---|---|---|---|
| Powder A | 0.004 | 0.05 | — | — | — | — |
| Powder B | 0.004 | 0.04 | 0.13 | — | 0.86 | — |
| Master alloy MA1 | 4.5 | 0.21 | 5.39 | 5.40 | 1.27 | 1.98 |

Figure 2:
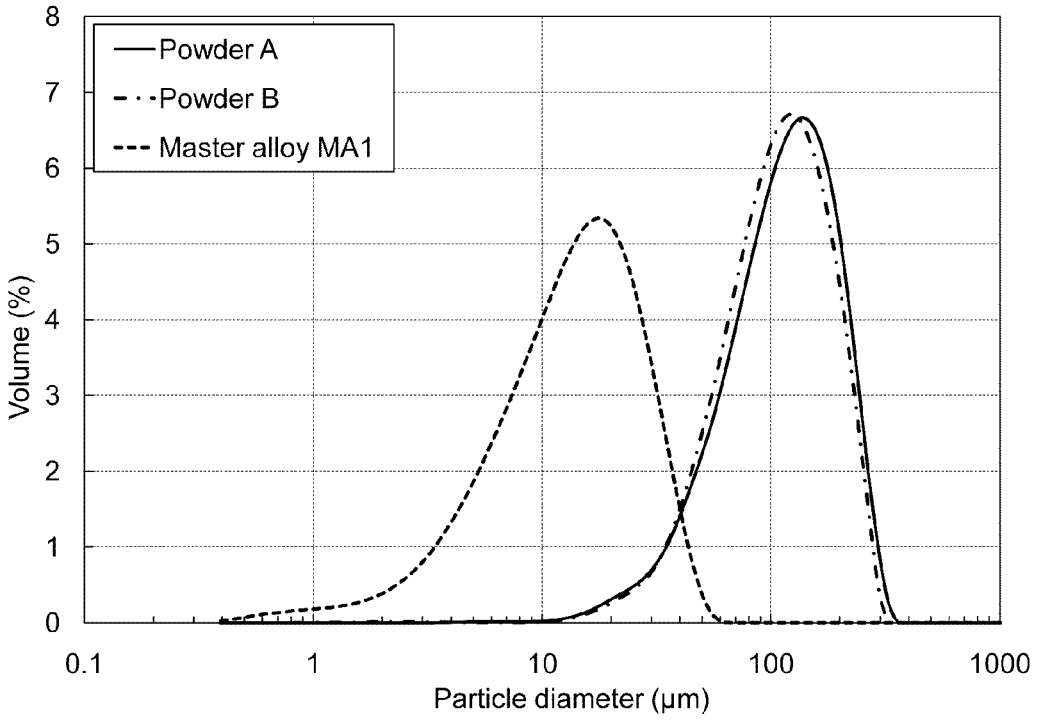
FIG. 2 is a graph of particle size distribution (particle diameter, μm vs. % volume) of the master alloy according to one embodiment and two base commercial steel metal powders.

The particle size distribution of the powders and master alloys are presented in FIG. 2 where the particle diameter (μm) vs. % volume is plotted. Table 2 includes the numerical values of the particle size of various fractions.

TABLE 2

| Particle size distribution characteristics | | | |
|---|---|---|---|
| Powder | $d_{10}$ (μm) | $d_{50}$ (μm) | $d_{90}$ (μm) |
| Powder A | 49 | 116 | 214 |
| Powder B | 49 | 110 | 203 |
| Master alloy MA1 | 4 | 14 | 30 |

An optical and electron microscopy investigation was undertaken on a MA1 master alloy, with the composition 4.5 wt % C; 5.39 wt % Mn; 5.4 wt % Cr; 1.27 wt % Mo and 1.98 wt % Si (in weight % in the master alloy). The as-atomized master alloy (MA1) contains three different phases: cementite, austenite and a third phase rich in Mo (phase 3). The first phase is alloyed cementite ($Fe_3C$) containing Cr, Mn and a small amount of Mo in solid solution. The second phase is austenite which contains Mn, Cr, Si, and C in solid solution. Therefore, carbon is not in carbide form in this phase. The third phase is relatively rich in Mo but also contains Si, Mn, Cr and C.

The results also show that the alloying elements such as Cr, Mn and Mo were not oxidized during atomization and further processing. The total oxygen content of the as-atomized powder was about 0.2 weight % O. In an embodiment, the total oxygen content of the as-atomized powder should be kept below about 1 weight % and, in another embodiment, the total oxygen content should be kept below about 0.5 weight %. This can be further reduced by a reduction heat treatment and/or grinding after atomization since reduction heat treatment and grinding help remove the thin oxide layer that inevitably forms around the particles during atomization in water. The concept of using a high C content melt to protect the alloying elements during atomization and subsequent processing was therefore effective. The formation of these phases containing carbon protects the alloying elements from oxidation. These phases are a solid solution of austenite or other compounds and/or phases containing the alloying elements and carbon.

The calculated final chemical composition of the sinter hardened steel parts for Examples 1 to 4 are presented in Table 3.

TABLE 3

| Chemical composition of sintered parts | | | | | | | |
|---|---|---|---|---|---|---|---|
| Calculated final comp. after Sintering | wt % C | wt % O | wt % Mn | wt % Cr | wt % Mo | wt % Cu | wt % Si |
| Example 1 | 0.72 | 0.13 | 0.86 | 0.72 | 0.16 | 1.00 | 0.08 |
| Example 2 | 0.64 | 0.06 | 0.40 | 0.28 | 0.86 | 1.07 | 0.03 |
| Example 3 | 0.9 | 0.15 | 1.1 | 1.14 | 0.26 | 1.00 | 0.4 |
| Example 4 | 0.9 | 0.10 | 0.50 | 0.54 | 0.13 | 1.00 | 0.2 |

Example 1

A master alloy MA1 prepared according to one embodiment of the process described above was mixed with steel powder A. In Example 1, 15 weight % of the master alloy MA1 was mixed with 84 weight % of powder A and with 1 weight % of elemental copper powder, and 0.7 weight % Kenolub (common polymeric lubricant). The lubricant is not calculated in the composition of the mixture including the master alloy and the steel powder since it evaporates during sintering, leaving no traces on the sintered part.

The mixture of MA1 and steel powder A was compressed into rectangular bars of dimensions 10 mm×10 mm×75 mm (Izod Impact Test specimen) at a density of approximately 6.95 g/cm$^3$.

The compressed samples were sintered at 1200° C. for 30 minutes in a semi-industrial furnace equipped with a convective cooling system for which the frequency of operation is variable (0 Hz to 60 Hz). The higher the frequency, the faster the cooling rate. Specimens were sintered under $90N_2$-$10H_2$ atmosphere and exposed to a controlled cooling at the end of the sintering cycle. The frequency of the convective cooling system was set to 15 Hz which represents an intermediate cooling rate.

Figure 3:
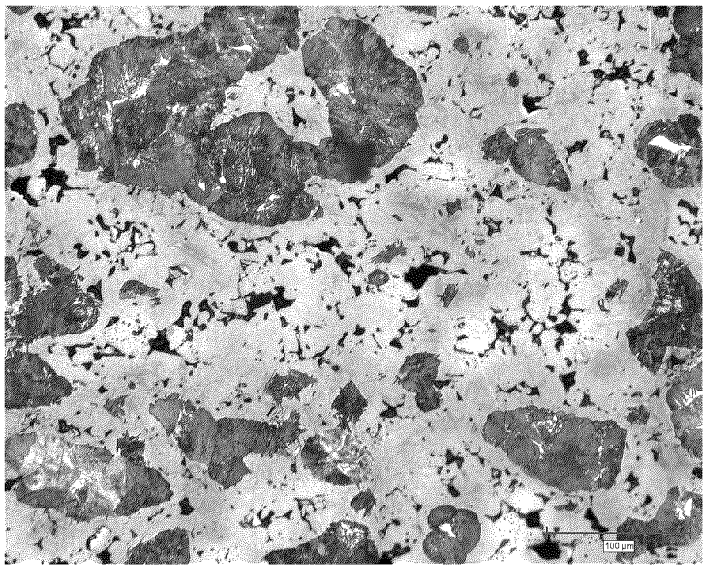
FIG. 3 is a micrograph of a sinter hardened steel part produced according to the embodiment of the process described in Example 1.

The microstructure of sinter hardened steel part of Example 1 (200×, etched with 2% nital/4% picral) is represented in FIG. 3. The microstructure of the steel part of Example 1 is composed of approximately 60% martensite and 40% of mixed bainite/pearlite (% by volume), martensite being the bright phase and the dark areas being constituted of a mixture of bainite and pearlite.

The apparent hardness of the steel part of Example 1 is approximately 34 HRC (@6.95 g/cm$^3$). HRC stands for Rockwell Hardness Scale C.

Thus, adding about 15 weight % of a master alloy to a substantially pure steel powder provides a sinter hardening potential to the resulting sinter hardened steel part.

Example 2

In Example 2, the mixture consists of 93.6 weight % of powder B, 5 weight % of master alloy MA1 and 0.4 weight % of graphite. All process conditions in Example 2 including lubricant and copper additions, compaction, sintering and controlled cooling, were conducted as in Example 1.

Figure 4:
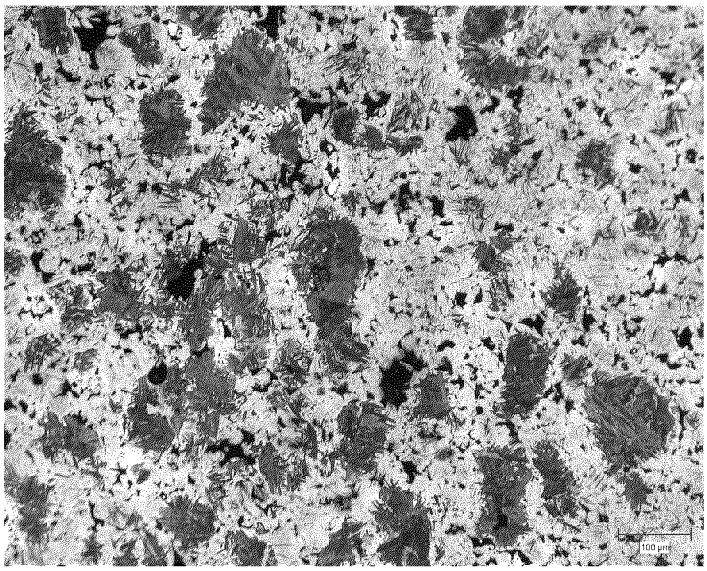
FIG. 4 is a micrograph of a second sinter hardened steel part produced according to the embodiment of the process described in Example 2.

The microstructure of the sinter hardened steel part of Example 2 (100×, etched with 2% nital/4% picral) is shown in FIG. 4 and is composed of approximately 50% martensite and 50% of mixed bainite/pearlite (% by volume). The apparent hardness of the steel part of Example 2 is approximately 35 HRC (@7.02 g/cm$^3$).

A reference mixture, free of master alloy, consisting of 98.4 weight % of powder C, 1 weight % of elemental copper, 0.7 weight % of graphite and 0.7 weight % of Kenolube, pressed and sintered in the same conditions as Example 2 shows an apparent hardness of only 89 HRB (~8.5 HRC). HRB stands for Rockwell Hardness Scale B, which is a softer hardness scale than HRC.

Adding about 5 weight % of the master alloy to the low alloyed steel powder B increases the sinter hardening potential of the resulting sinter hardened steel part.

Example 3

In Example 3, the mixture consists of about 79 weight % of powder A, 20 weight % of master alloy MA1, 1 weight % of elemental copper powder and 0.7 weight % Kenolube. The compacted samples were sintered in a laboratory furnace with controllable cooling rate under a flowing argon atmosphere. The effective cooling rate for Example 3 in the temperature range from 550° C. to 350° C. is approximately 0.65° C./second (39° C./minute).

Figure 5:
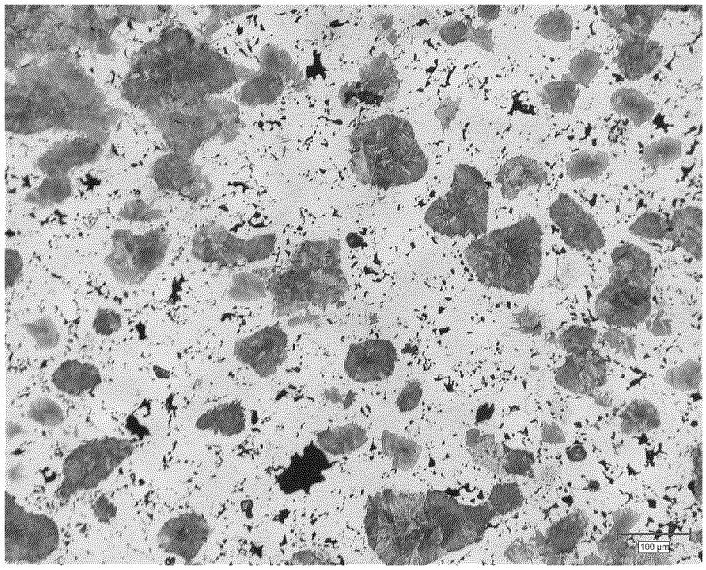
FIG. 5 is a micrograph of a third sinter hardened steel part produced according to the embodiment of the process described in Example 3.

The microstructure of the sinter hardened steel part of Example 3 (100×, etched with 2% nital/4% picral) is shown in FIG. 5 and is 70% martensite and 30% of mixed bainite/pearlite (% by volume). The apparent hardness of the steel part of Example 3 in the as-sintered condition is approximately 37 HRC (@6.9 g/cm$^3$). After a tempering heat treatment at 200° C. for 1 hour, the apparent hardness of the steel part in the tempered condition is 33 HRC (@9 g/cm$^3$).

By using a higher cooling rate, it is possible to improve the sinter hardening response of the mix described in Example 3. Hence, for an effective cooling rate of approximately 1.9° C./second (115° C./minute) in the temperature range from 550° C. to 350° C., the apparent hardness of the part after sinter hardening reaches 45 HRC. The as-sintered microstructure is 80% martensite and 20% of mixed bainite/pearlite (% by volume). An apparent hardness of 37 HRC is observed in the tempered state (200° C. for 1 hour).

Example 4

In Example 4, the mixture consists of 89 weight % of powder A, 10 weight % of master alloy MA1, 1 weight % of elemental copper powder and 0.7 weight % Kenolube. The compacting and sintering conditions of Example 4 were conducted as in Example 3. The effective cooling rate for Example 4 in the temperature range from 550° C. to 350° C. is different from Example 3 and is approximately 1.4° C./second (83° C./minute).

Figure 6:
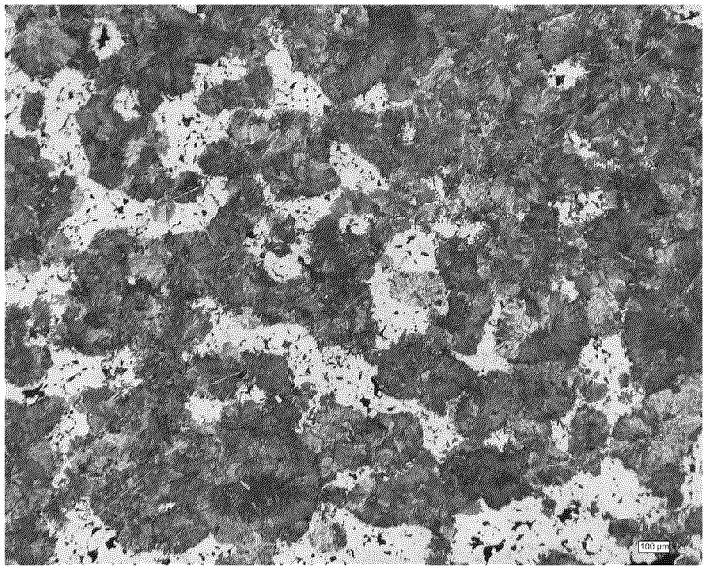
FIG. 6 is a micrograph of a fourth sinter hardened steel part produced according to the embodiment of the process described in Example 4.

The microstructure of the sinter hardened steel part of Example 4 (100×, etched with 2% nital/4% picral) is shown in FIG. 6 and is 20% martensite and 80% of mixed bainite/pearlite (% by volume). The apparent hardness of the steel part of Example 4 in the as-sintered condition is approximately 25 HRC (@7.0 g/cm$^3$).

Examples 3 and 4 show the effect of the cooling rate and the following heat treatment, if any, on the sintered part properties including its hardness.

The master alloys obtained by atomization and grinding have finer microstructures than ferroalloys obtained by casting, crushing, and grinding.

Furthermore, the mixture including the master alloy and the base steel powder is more compressible than prealloyed sinter hardening powders that are commonly used and mixtures of base steel powder and ferroalloys.

The embodiments of the invention described above are intended to be exemplary. Those skilled in the art will therefore appreciate that the foregoing description is illustrative only, and that various alternate configurations and modifications can be devised without departing from the spirit of the present invention. Accordingly, the present invention is intended to embrace all such alternate configurations, modifications and variances which fall within the scope of the appended claims.

The invention claimed is:

1. A master alloy for sinter hardened steel parts, the master alloy comprising a composition of iron;

at least 4.5 to less than about 7 weight % C in the master alloy, 5.39 to less than about 20 weight % Mn in the master alloy, 5.40 to less than about 20 weight % Cr in the master alloy, no Si, with the exception of Si possibly present as an inevitable impurity, no Ni, with the exception of Ni possibly present as an inevitable impurity, wherein the master alloy is in the form of water atomized particulates having a total oxygen content below about 1 weight %, and wherein the master alloy comprises a microstructure including a mixture of austenite and cementite and the austenite microstructure is composed of a solid solution of the manganese, chromium, and carbon, the microstructure comprising at least 60 volume % austenite;

wherein the carbon is pre-alloyed in the master alloy, and the hardness of the master alloy is less than 900 Vickers.

2. The master alloy of claim 1, wherein the particulate size of the water atomized particulates is controlled by atomization and grinding.

3. The master alloy of claim 1, wherein the water atomized particulates have a $d_{50}$ from 5 μm to 30 μm and a $d_{90}$ from 20 μm to 60 μm.

4. The master alloy of claim 1, wherein the composition further comprises less than 10 weight % Mo in the master alloy.

5. The master alloy of claim 1, wherein the composition further comprises less than 10 weight % Cu in the master alloy.

6. The master alloy of claim 1, wherein the composition further comprises less than 5 weight % V, less than 5 weight % W, less than 5 weight % Nb, less than 1 weight % P, less than 0.1 weight % B in the master alloy, and wherein the remainder of the composition is iron and inevitable impurities.

7. The master alloy of claim 1, wherein the master alloy comprises at least 60 weight % of iron.

* * * * *